US008350198B2

(12) United States Patent
Belsh et al.

(10) Patent No.: US 8,350,198 B2
(45) Date of Patent: Jan. 8, 2013

(54) HEATING AND MELTING OF MATERIALS BY ELECTRIC INDUCTION HEATING OF SUSCEPTORS

(75) Inventors: Joseph T. Belsh, Mount Laurel, NJ (US); Satyen N. Prabhu, Voorhees, NJ (US); John H. Mortimer, Little Egg Harbor Township, NJ (US); Vitaly A. Peysakhovich, Moorestown, NJ (US)

(73) Assignee: Inductotherm Corp., Rancocas, NJ (US)

( * ) Notice: Subject to any disclaimer, the term of this patent is extended or adjusted under 35 U.S.C. 154(b) by 436 days.

(21) Appl. No.: 12/647,471

(22) Filed: Dec. 26, 2009

(65) Prior Publication Data

US 2010/0163550 A1 Jul. 1, 2010

Related U.S. Application Data

(60) Provisional application No. 61/140,897, filed on Dec. 26, 2008.

(51) Int. Cl.
*H05B 6/10* (2006.01)

(52) U.S. Cl. ..... 219/634; 219/535; 219/600; 373/142

(58) Field of Classification Search ..... 219/634, 219/635, 636, 637, 600, 618, 165, 266, 649; 373/142

See application file for complete search history.

(56) References Cited

U.S. PATENT DOCUMENTS

| | | | | |
|---|---|---|---|---|
| 4,608,473 | A | 8/1986 | Paek et al. | |
| 5,588,019 | A * | 12/1996 | Ruffini et al. | 373/152 |
| 5,939,016 | A | 8/1999 | Mathiesen et al. | |
| 2008/0267251 | A1 * | 10/2008 | Gerszewski et al. | 373/142 |

FOREIGN PATENT DOCUMENTS

JP 06-104076 A 4/1994

* cited by examiner

*Primary Examiner* — David Nhu
(74) *Attorney, Agent, or Firm* — Philip O. Post

(57) ABSTRACT

Apparatus and method are provided for heating and melting of materials by electric induction heating of susceptor components in a crucible of the furnace. The susceptor components comprise at least an array of susceptor rods arranged around the inner perimeter of the crucible. A susceptor base may also be provided in the crucible with connection to one end of the susceptor rods. One or more susceptor tubes may also be used within the interior volume of the crucible. Alternating current flow through one or more induction coils surrounding the exterior of the crucible generate magnetic flux fields that couple with the susceptor components to inductively heat the susceptor components. Heat from the susceptor components transfers to the material in the crucible to heat and melt the material.

13 Claims, 14 Drawing Sheets

HEATING AND MELTING OF MATERIALS BY ELECTRIC INDUCTION HEATING OF SUSCEPTORS

CROSS REFERENCE TO RELATED APPLICATIONS

This application claims the benefit of U.S. Provisional Application No. 61/140,897, filed Dec. 26, 2008, hereby incorporated by reference in its entirety.

FIELD OF THE INVENTION

The present invention relates to heating and melting of a material in a furnace by electric induction heating of susceptors in the furnace with heat transfer from the susceptors to the material.

BACKGROUND OF THE INVENTION

Susceptor vessels can be used to heat and melt materials that are non-electrically conductive by electric induction heating of the susceptor vessel and transfer of heat from the susceptor vessel to the materials in the vessel.

It is one object of the present invention to provide a furnace that can be used to heat and melt materials that are non-electrically conductive by electric induction heating of susceptor components disposed in the furnace, with heat transfer from the susceptor components to the material in the furnace.

BRIEF SUMMARY OF THE INVENTION

In one aspect the present invention is apparatus for, and method of, heating and melting of materials by electric induction heating of susceptor components in an induction furnace. The susceptor components comprise at least an array of susceptor rods arranged around the inner perimeter of a crucible. A susceptor base may also be provided in the crucible with connection to one end of the susceptor rods. One or more susceptor tubes may also be provided within the crucible. Alternating current flow through one or more induction coils surrounding the exterior of the crucible generate magnetic flux fields that couple with the susceptor components to inductively heat the susceptor components. Heat from the susceptor components transfers to the material in the furnace to heat and melt the material. The furnace may be of a bottom pour or pressure pour configuration. A defective susceptor rod sensor device can be provided for detecting a damaged susceptor rod or susceptor tube. In some examples of the invention, a resistive heating power source is connected between the susceptor rods, and susceptor tubes, if used, and the susceptor base to provide resistive heating of the susceptor materials. A susceptor rod fastening device can be provided for holding the susceptor rods vertically in position in the crucible. The susceptor rod fastening device may also include a susceptor rod release and removal mechanism for removal of a susceptor rod while the furnace is heating or melting a composition placed in the crucible. The furnace may include a lid that can form a sealed environment within the crucible.

In operation the output frequency of the alternating current power sources connected to the one or more induction coils can be adjusted to selectively control the magnitude of induced heating to the array of discrete susceptor components.

In some embodiments of the invention, the furnace may have an open bottom so that solid charge supplied at the top of the furnace exits the open bottom of the furnace in continuous molten form.

The above and other aspects of the invention are set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings.

FIG. 1(*b*) is a cross sectional elevation view of the apparatus in FIG. 1(*a*) through line A-A.

FIG. 11(*b*) is a cross sectional elevation view of the apparatus in FIG. 11(*a*) through line B-B.

DETAILED DESCRIPTION OF THE INVENTION

Figure 1A:
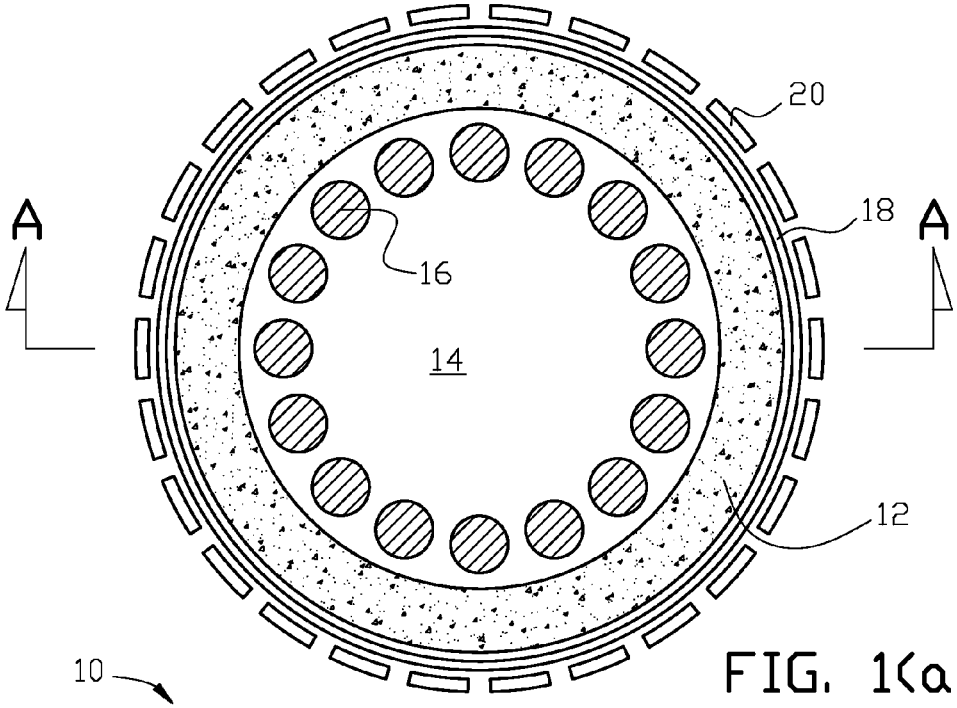
FIG. 1(*a*) is an open top plan view of one example of the electric induction heating and melting apparatus of the present invention.
Figure 1B:
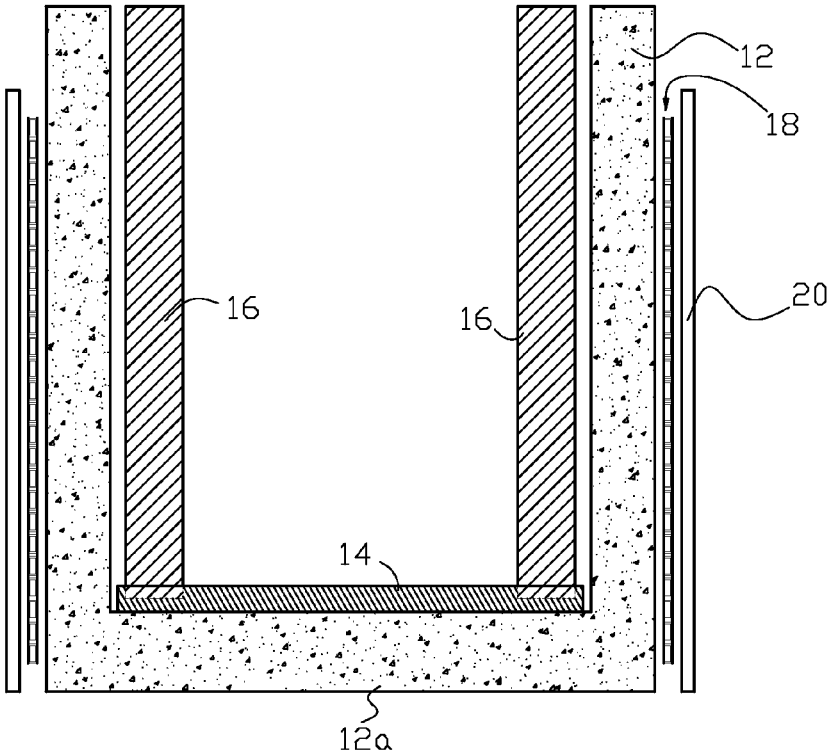

There is shown in FIG. 1(*a*) and FIG. 1(*b*) one example of an electric induction heating and melting apparatus 10 (induction heating furnace) of the present invention. Crucible 12 is formed from suitable refractory. Susceptor base 14 is located at the bottom 12*a* of the interior of crucible 12. Susceptor rods 16 are arrayed around the inner perimeter of the crucible. A section of the susceptor rods may be in contact with the inner wall of the crucible, or offset from the inner wall of the crucible, depending upon the requirements of a particular application. The susceptor rods may be suitably fastened to the susceptor base, for example, by a threaded connection to the base. One or more induction coils 18 surround the exterior height of the crucible so that when the one or more induction coils are suitably connected to one or more alternating current (AC) power sources (not shown in the figures), magnetic flux is generated by current flow in the coils. The flux couples with the susceptor base and rods to inductively heat the base and rods. Heat from the susceptor base and rods transfers by conduction to any type of charge placed in the crucible, and as the charge melts, heat transfers through the melt by convection. Therefore the apparatus of the present invention is particularly suitable for heating and melting by electric induction compositions of materials classified as electrical semiconductors, or compositions that have an electrical conductivity less than that of a semiconductor material. If the charge is a material that transitions from non-electrically conductive in the solid state (as charge supplied to the furnace) to electrically conductive in the molten state, such as silicon, in addition to heat transfer from the susceptor base and rods, once the charge melts, the molten material may, at least partially, be inductively heated by coupling with the flux field penetrating around the susceptor rods into the interior of the crucible. In these examples of the invention, with properly selected output frequencies and phasing from the one or more power supplies to the one or more induction coils, an electromagnetic stirring action may be established in the molten material. Electromagnetic shunts 20 can be provided around the exterior perimeter of the one or more induction coil to direct magnetic flux towards the interior of the crucible and the susceptor base and rods.

The susceptor base and rods may be formed from any suitable susceptor material such as a graphite composition. If the induction furnace is used to heat or melt a material that may be contaminated by contact with the graphite composition, for example silicon, the outer surfaces of the susceptor base and rods may be treated to form a protective boundary layer on the base and rods. Alternatively the outer surfaces of the susceptor base and rods may be covered with a suitable liner material, such as silica, to protect the molten material from contamination with susceptor material.

Although sixteen susceptor rods are arrayed around the inner perimeter of the crucible shown in FIG. 1(*a*) and FIG. 1(*b*), any other number of susceptor rods may be used in other examples of the invention as appropriate for a particular application.

In some examples of the invention susceptor base 14 may not be used, and susceptor rods 16 may be suitably connected to the base of crucible 12.

Figure 2:
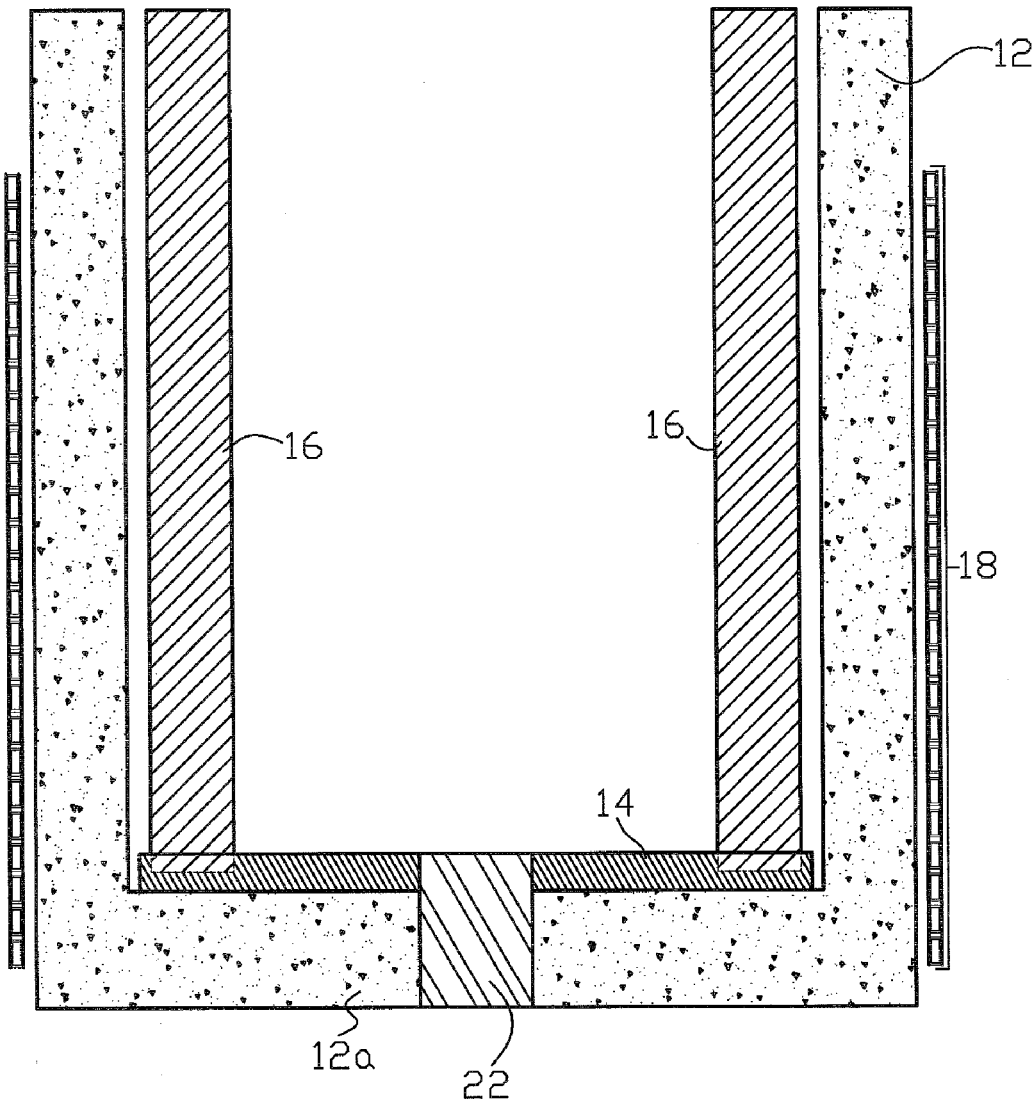
FIG. 2 is a cross sectional elevation view of another example of the electric induction heating and melting apparatus of the present invention.

There is shown in FIG. 2 another example of the electric induction heating and melting apparatus of the present invention. In this example the induction furnace is a bottom pour furnace wherein a suitable bottom tap device 22 (shown in outline) is provided in the crucible base 12*a* for bottom draw of molten material from the furnace. The tap device may be any suitable tap device, such as a replaceable plug, mechanical valve, electromagnetically controlled valve or a molten material freeze plug that is selectively opened (unfrozen) by supplying AC power to an induction coil surrounding the molten material freeze plug.

Figure 3:
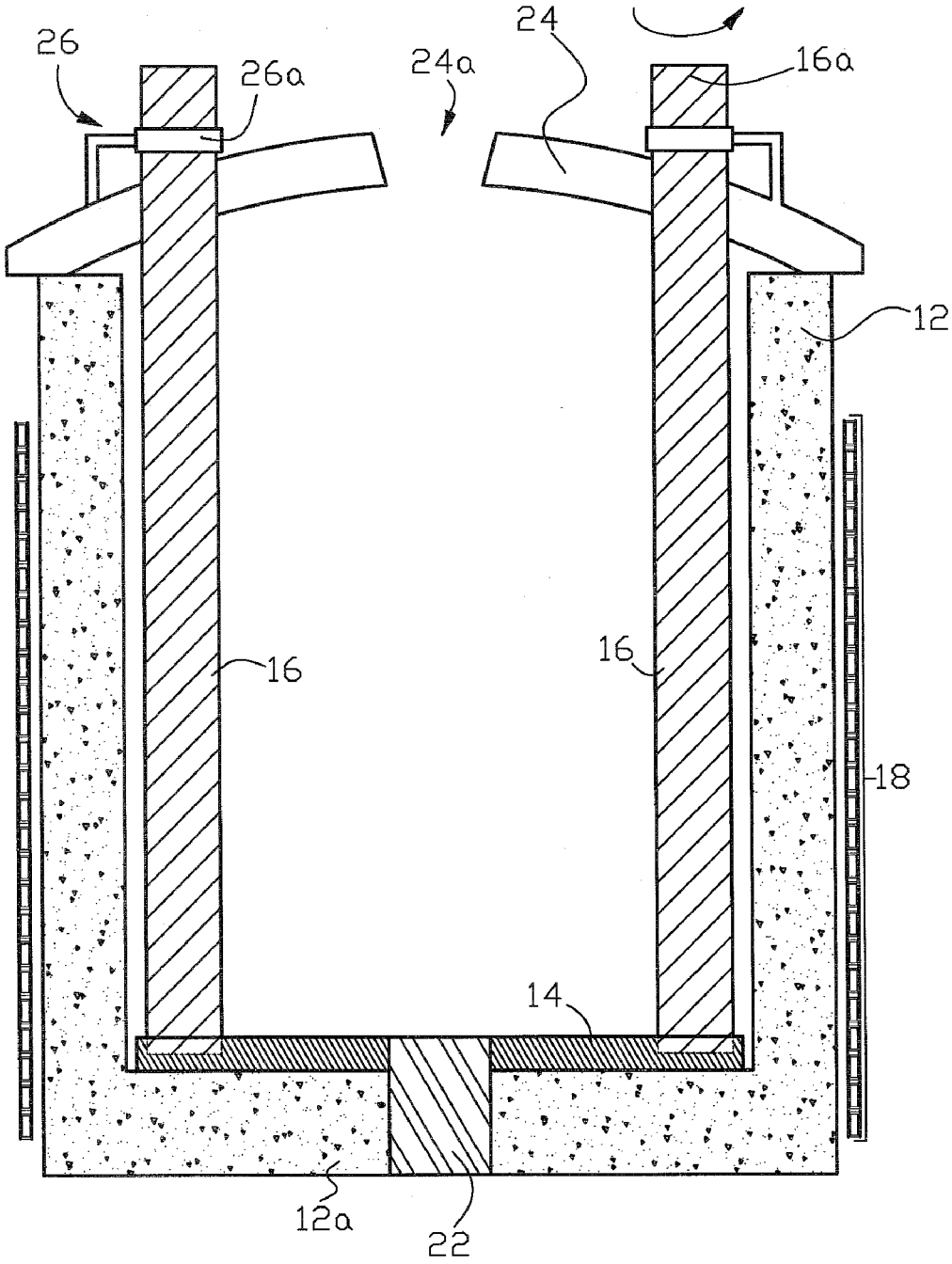
FIG. 3 is a cross sectional elevation view of another example of the electric induction heating and melting apparatus of the present invention.

There is shown in FIG. 3 another example of the electric induction heating and melting apparatus of the present invention. In this example lid 24 is used as one method of retaining susceptor rods 16 in place, and to facilitate removal of one or more of the susceptor rods. Optional opening 24*a* in lid 24, which opening may be optionally sealable, can be used as a charge port for loading additional charge into the induction furnace as melt in the induction furnace is drawn from the furnace, for example, through bottom tap device 22.

Figure 4:
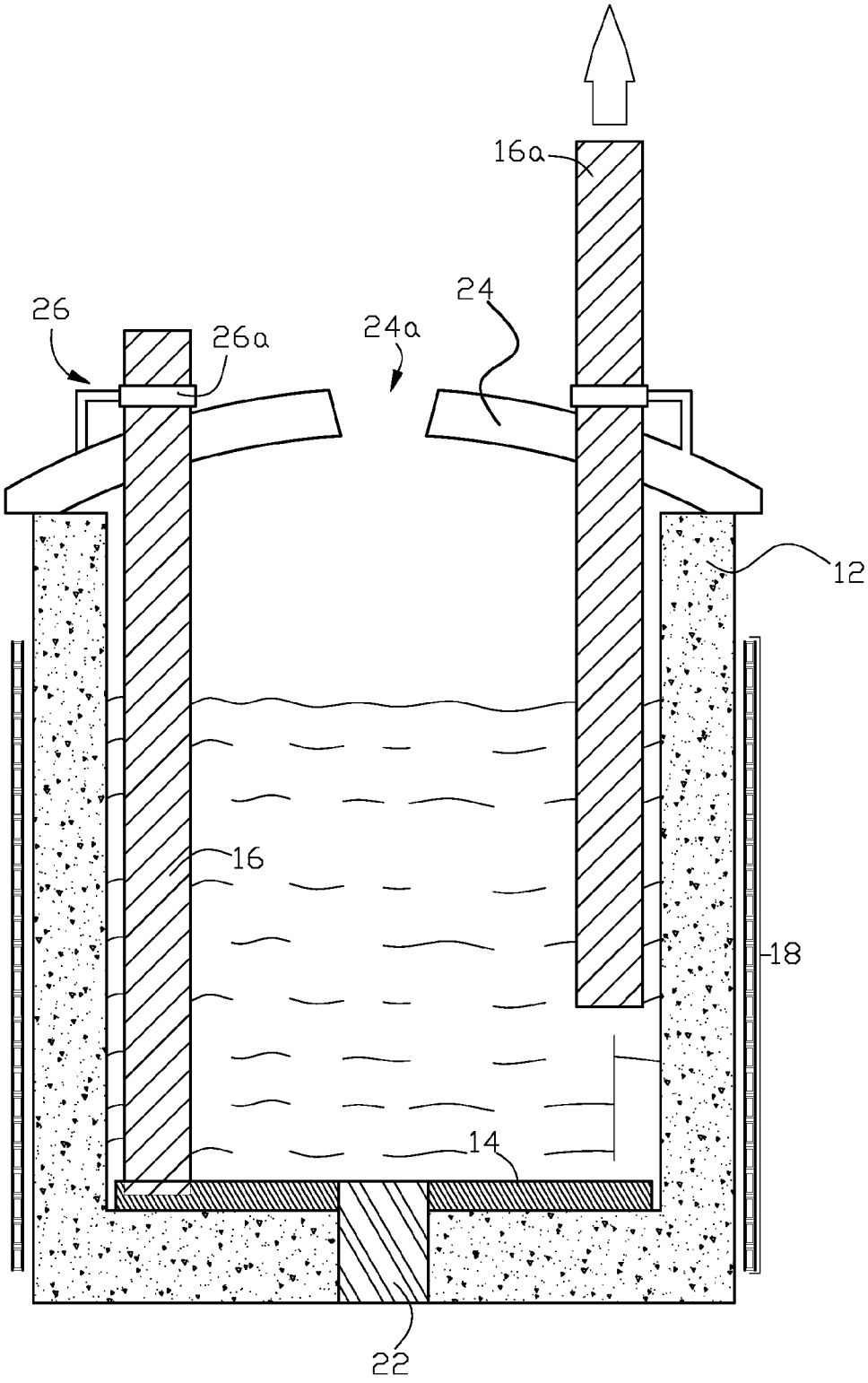
FIG. 4 is a cross sectional elevation view of the apparatus in FIG. 3 illustrating one example of removal of a susceptor rod while the induction heating and melting apparatus is in operation.

Susceptor rod fastening device 26, such as, but not limited to, a compression ring assembly, which is attached to lid 24 may be used to retain each susceptor rod in place while the lid is located over the furnace as shown in FIG. 3. A susceptor rod can be locked in operational position as shown in FIG. 3 by locking compression ring 26*a* around the susceptor rod. The compression ring can serve as a susceptor rod release and removal mechanism. Replacement of one or more of the susceptor rods may be accomplished while the furnace is in operation and loaded at least partially with charge and molten material by unlocking the compression ring associated with the susceptor rod to be removed and raising the susceptor rod through lid 24 as shown, for example, in FIG. 4. In this arrangement one suitable method of securing each susceptor rod to the susceptor base is via a threaded connection so that the susceptor rod to be removed could be turned at rod end 16*a* above the lid to release the rod from the base and raise it out of the furnace while the furnace is in operation. Other methods may be used to achieve a physical, and optionally an electrical, connection between one or more of the susceptor rods and the base; for example, the end of a rod may be force fitted into the base, or perimeter key inserts may be used at the interconnection between the end of a rod and the base.

A susceptor rod may become defective and require replacement while the furnace is in operation. For example if the susceptor rods are formed from a graphite composition, a rod may fracture. Suitable defective susceptor rod sensor devices can be provided to detect damage to a rod. For example the impedance of the load circuit from the one or more power supplies will noticeably change if a rod is damaged; the defective susceptor rod sensor device can monitor load circuit impedance and indicate abnormal changes in load circuit impedance that reflect a defective susceptor rod. Further a megohm metering system may be used as a defective susceptor rod sensor to detect changes in resistance between the end of each individual rod protruding outside of the lid and the base susceptor.

Figure 5:
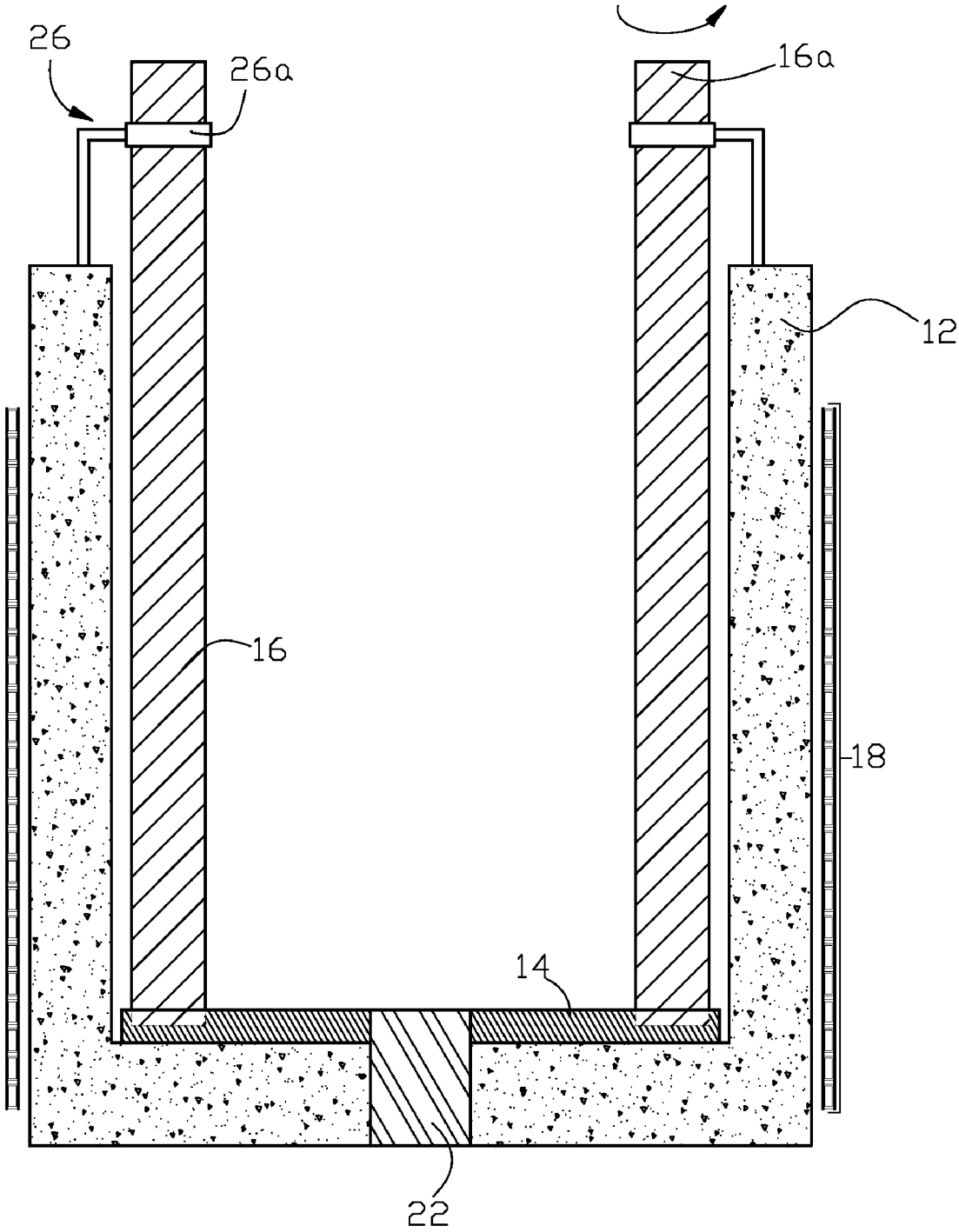
FIG. 5 is a cross sectional elevation view of another example of the electric induction heating and melting apparatus of the present invention.

In other examples of the invention retention of the susceptors may be accomplished by a retaining system independent of the lid, for example, as shown in the FIG. 5.

Figure 6:
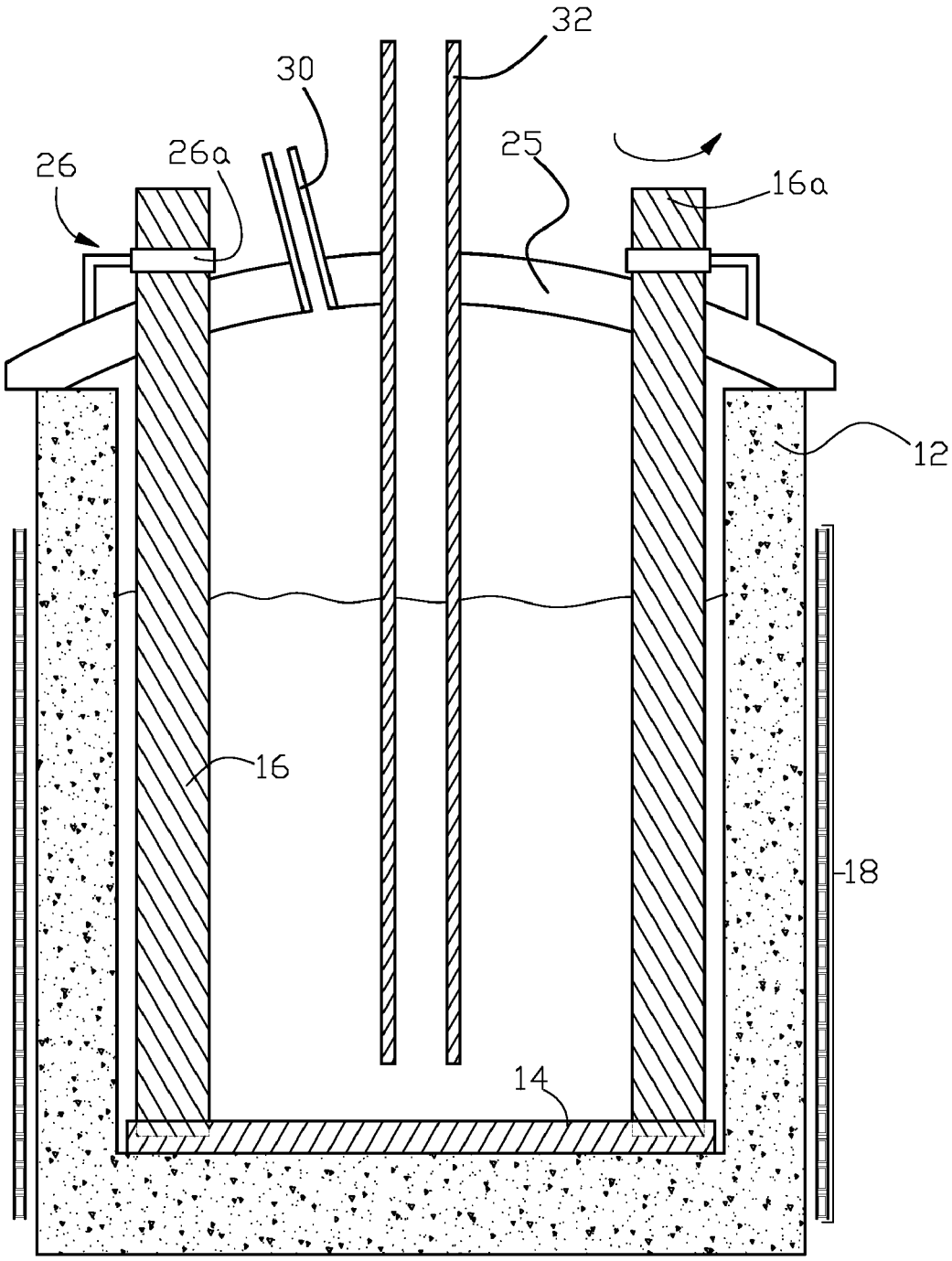
FIG. 6 is a cross sectional elevation view of another example of the electric induction heating and melting apparatus of the present invention.

FIG. 6 illustrates another example of the electric induction heating and melting apparatus of the present invention. In this example the furnace is a pressure pour furnace wherein lid 25 forms a sealed cover over molten material in the furnace. A pressurized gas can be inject into the furnace via port 30 over the surface of the molten material in the furnace to force the molten material up outlet tube 32 and into a suitable container, launder or piping system.

Figure 7A:
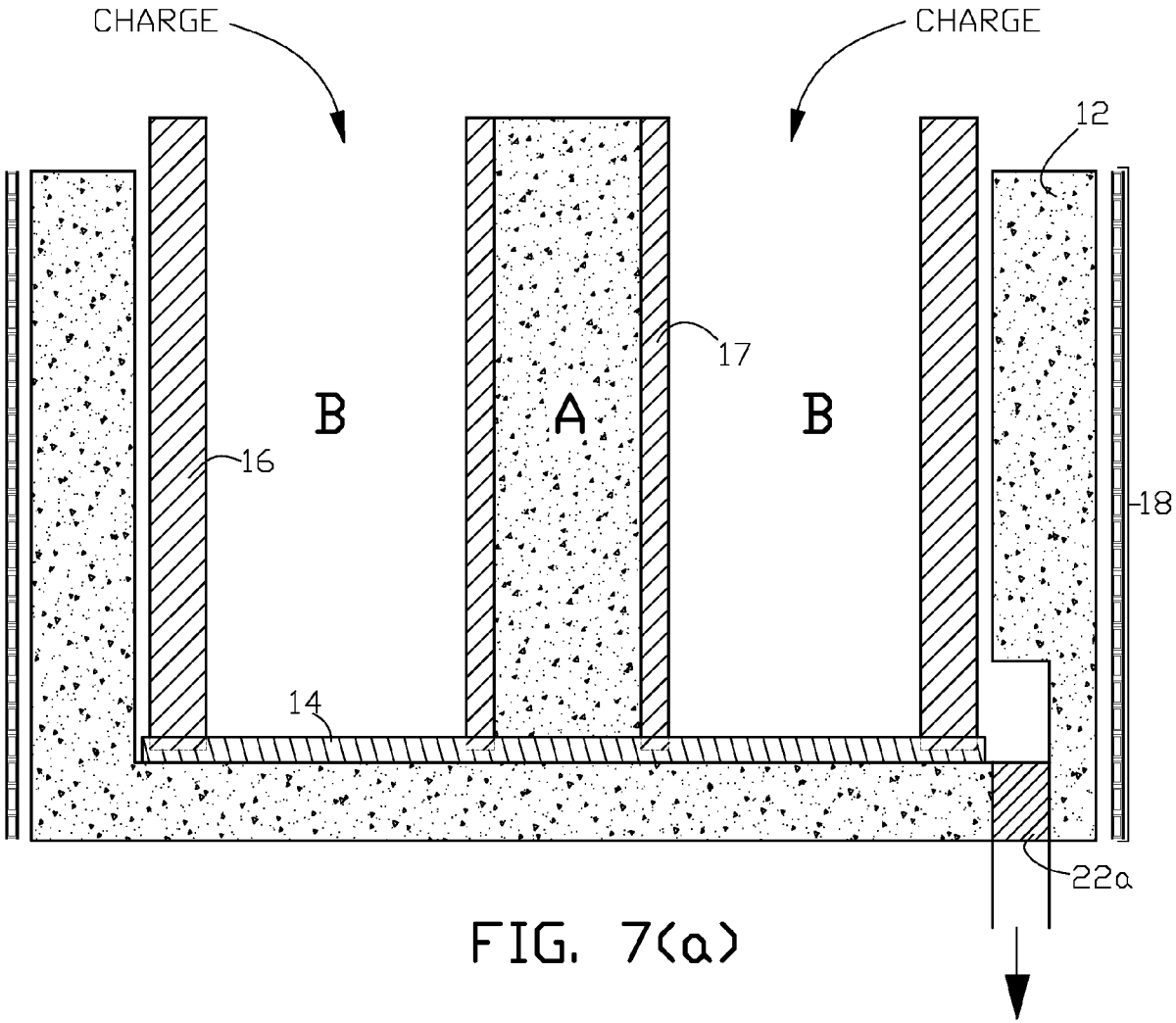
FIG. 7(*a*) and FIG. 7(*b*) are cross sectional elevation views of examples of the electric induction heating and melting apparatus of the present invention utilizing a susceptor tube.
Figure 7B:
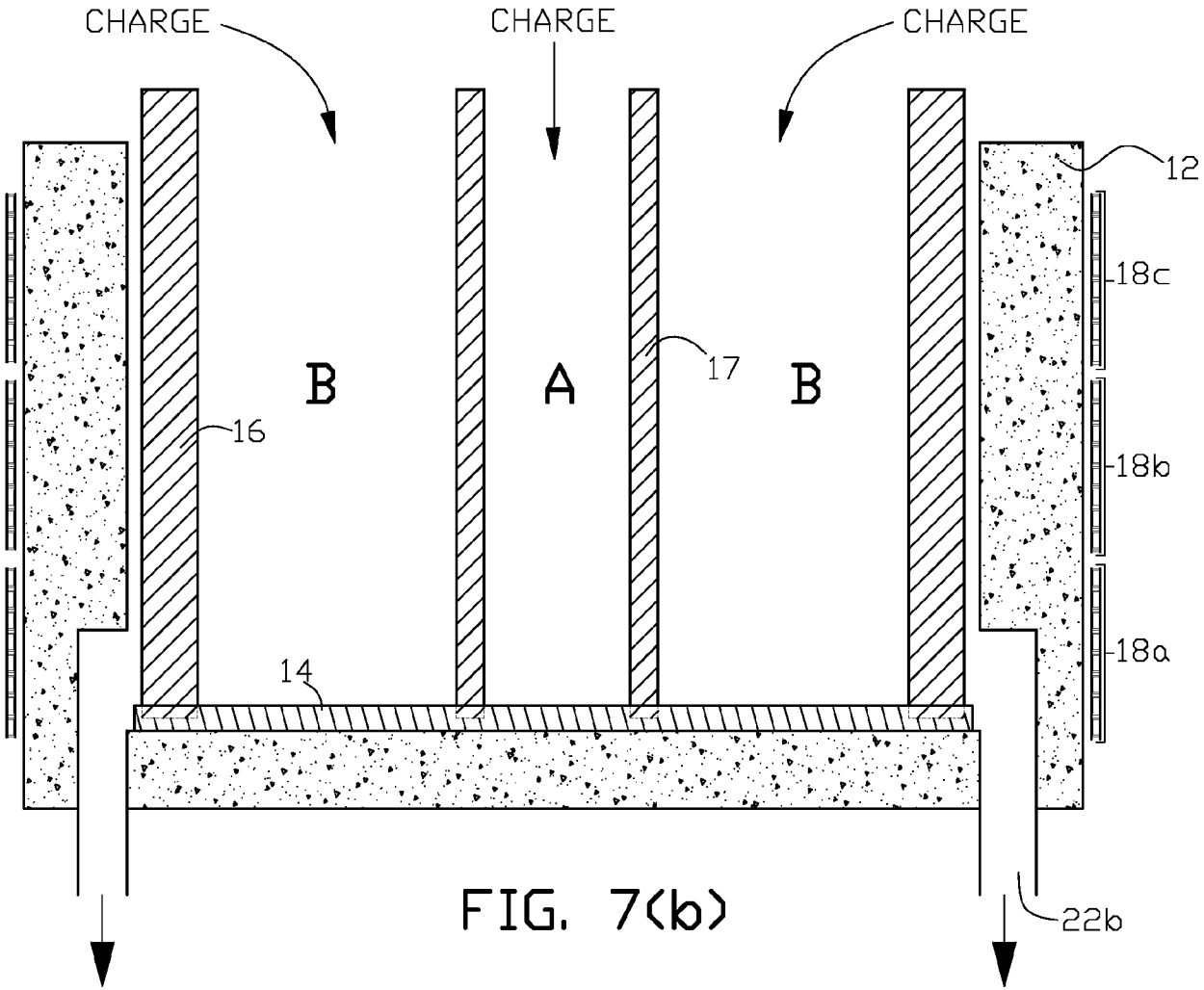

FIG. 7(*a*) and FIG. 7(*b*) illustrate examples of the electric induction heating and melting apparatus of the present invention wherein in addition to base susceptor 14 and perimeter rod susceptors 16, there is a centrally located susceptor tube 17 having an annulus-shaped cross section. This arrangement is particularly advantageous when one or more variable frequency power supplies are used to supply power to the one or more induction coils surrounding the crucible of the furnace. Depending upon physical sizing of the perimeter susceptor rods and central susceptor tube, relative magnitudes of induced heating in the perimeter susceptor rods and central susceptor tube can be adjusted by changing the output frequency of the one or more power supplies connected to the one or more induction coils surrounding the crucible. For example with the furnace initially loaded with solid charge, it may be desirable to inductively heat the outer regions of the perimeter susceptor rods and central susceptor tube to approximately the same maximum temperature. Temperature sensors, such as thermocouples, may be embedded along the length of the susceptor rods and tube to sense the temperature of the rods and tube as they are inductively heated up to maximum operating temperature. Once the susceptor rods and tube are brought up to maximum operating temperature as sensed by the temperature sensors, it may be desired to induce a greater magnitude of heating in the perimeter susceptor rods than in the central susceptor tube since heat loss from the outer perimeter susceptor rods will be greater than heat loss in the centrally located susceptor tube. By reducing the output frequency of the one or more power supplies, inductive heating to the susceptor rods can be increased while inductive heating of the susceptor tube is decreased. That is, more generally, changing the output frequency of the one or more power supplies will change the relative magnitude of induced heating between the perimeter susceptor rods and the central susceptor tube. A desired process heating profile may be stored in digital form in a suitable electronic data storage device and executed by a computer program in a processing device responsive to temperatures sensed by the temperature sensors in the susceptors during the heating process. In FIG. 7(*a*) single induction coil 18 is connected to a single power supply; therefore change in output frequency changes the ratio of induced heating along the entire length of the susceptor rods and tubes. In FIG. 7(*b*) induction coils 18*a*, 18*b* and 18*c*, each surround a partial height of the crucible. Consequently providing power to each of the three induction coils from a separate variable frequency output power supply allows greater flexibility in controlling the ratio of induced heat along the entire length of the susceptor rods and tubes. Alternatively switching the output of a single power supply among the three coils can also be used in other examples of the invention. Further pulse width modulation may be used to control the magnitude of variable power supplied to each of the one or more induction coils.

Figure 8B:
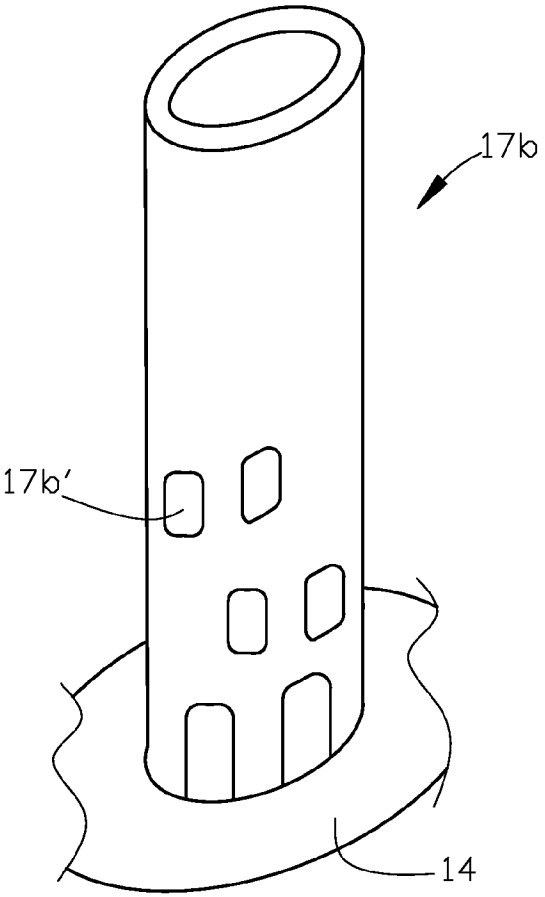
FIG. 8(*a*) and FIG. 8(*b*) are isometric views of alternative susceptor tubes that can be utilized with the apparatus shown in FIG. 7(*b*).
Figure 8A:
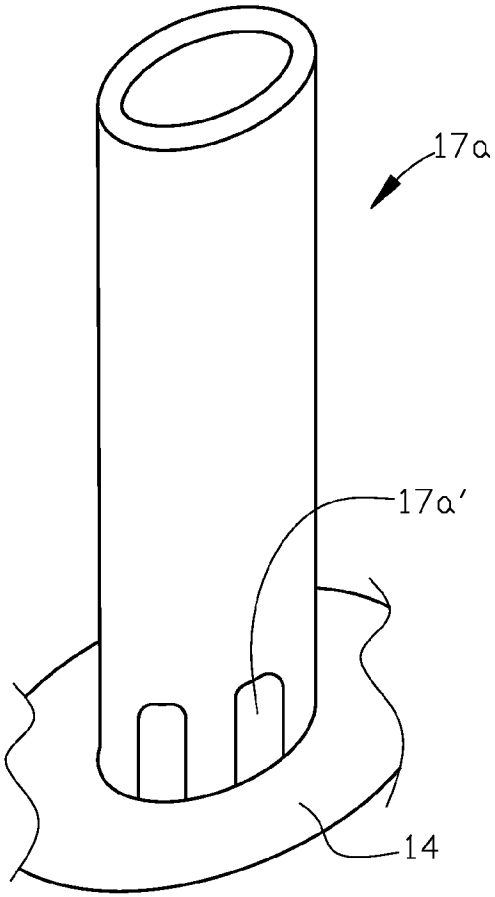

In some examples of the invention, as illustrated in FIG. 7(*a*), volume A within the annulus region of central susceptor tube 17 may be filed with refractory while charge is loaded into annular volume B between the outer wall of the susceptor tube and the inner wall of crucible refractory 12. In other examples of the invention, as illustrated in FIG. 7(*b*) charge may be supplied to volume A as well as volume B. When charge is supplied to volume B the susceptor tube can have on or more openings along its length to allow charge that has melted to flow into volume B. FIG. 8(*a*) and FIG. 8(*b*) illustrate two non-limiting examples of openings in the susceptor tube that can be utilized. For susceptor tube 17*a* in FIG. 8(*a*) openings 17*a*' are concentrated near the bottom of the tube adjacent to the tube's interface with base susceptor 14, while in FIG. 8(*b*) openings 17*b*' in susceptor tube 17*b* are distributed along the bottom half length of the tube.

Discharge of molten material from the induction furnaces illustrated in FIG. 7(*a*) and FIG. 7(*b*) can be of any suitable method, for example, as illustrated in other examples of the invention. The furnace may be a tilting pouring furnace, a pressure pour furnace or a bottom drain furnace. For bottom drain furnaces a suitable bottom side tap device 22*a* (shown in outline in FIG. 7(*a*)) can be provided in the crucible. The tap device may be any suitable tap device, such as a replaceable plug, mechanical valve, electromagnetically controlled valve or a molten material freeze plug that is selectively opened (unfrozen) by supplying AC power to an induction coil surrounding the molten material freeze plug. Alternatively as shown in FIG. 7(*b*) an annulus tap device 22*b* may be provided around the entire perimeter of the bottom of the crucible whereby molten material can be fed to other process apparatus directly from the induction furnace, or to a heated holding ladle or holding furnace for later transfer to other process apparatus.

While there is a single centrally located susceptor tube utilized in the examples of the invention shown in FIG. 7(*a*) and FIG. 7(*b*), in other examples of the invention there may be more than one susceptor tube arranged in different locations within the inner perimeter established by the susceptor rods 16 in the crucible. Alternatively supplemental susceptor rods may be utilized within the boundary of susceptor rods 16 either with, or without, susceptor tubes.

Figure 9A:
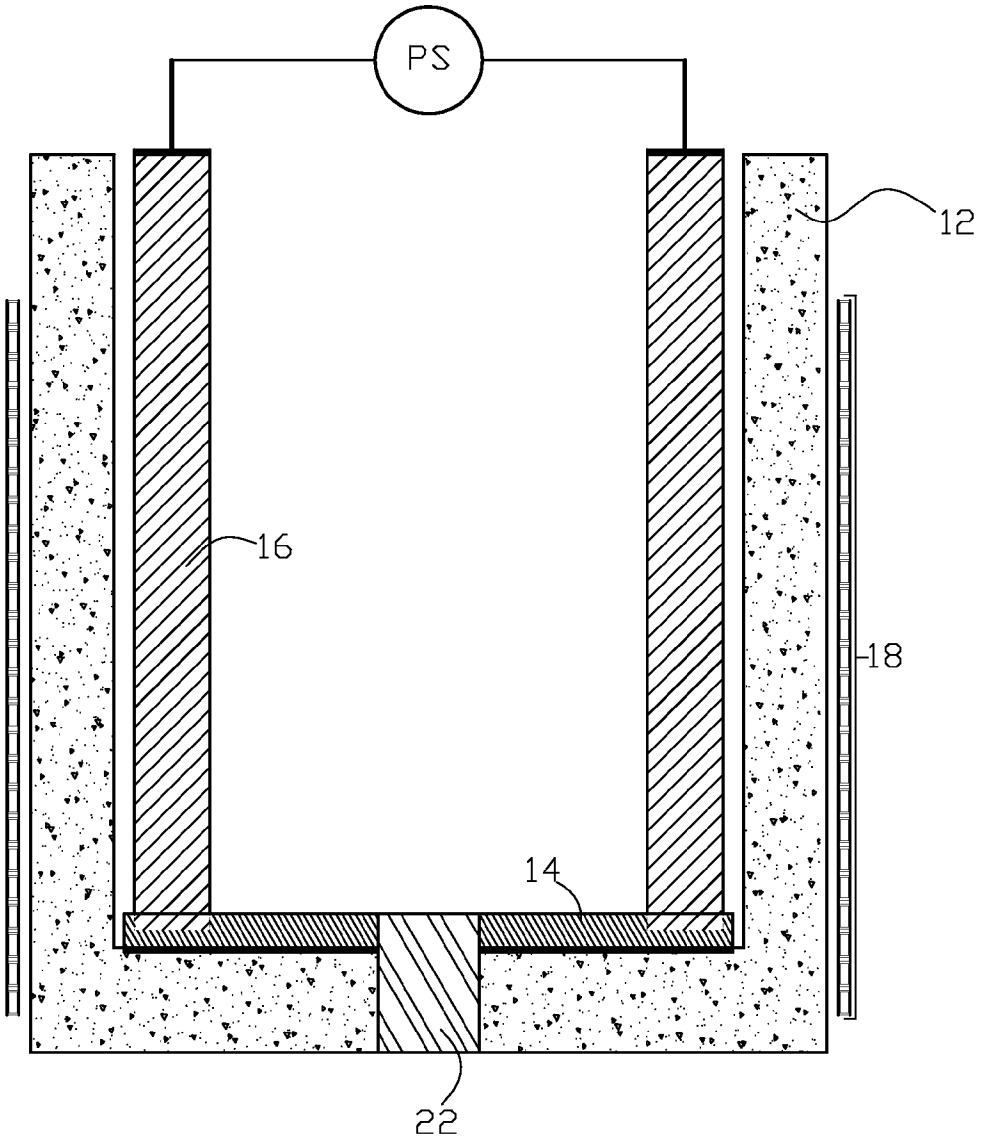
FIG. 9(*a*) and FIG. 9(*b*) illustrate in cross sectional elevation views examples of the electric induction heating and melting apparatus of the present invention utilizing supplemental susceptor Joule heating.
Figure 9B:
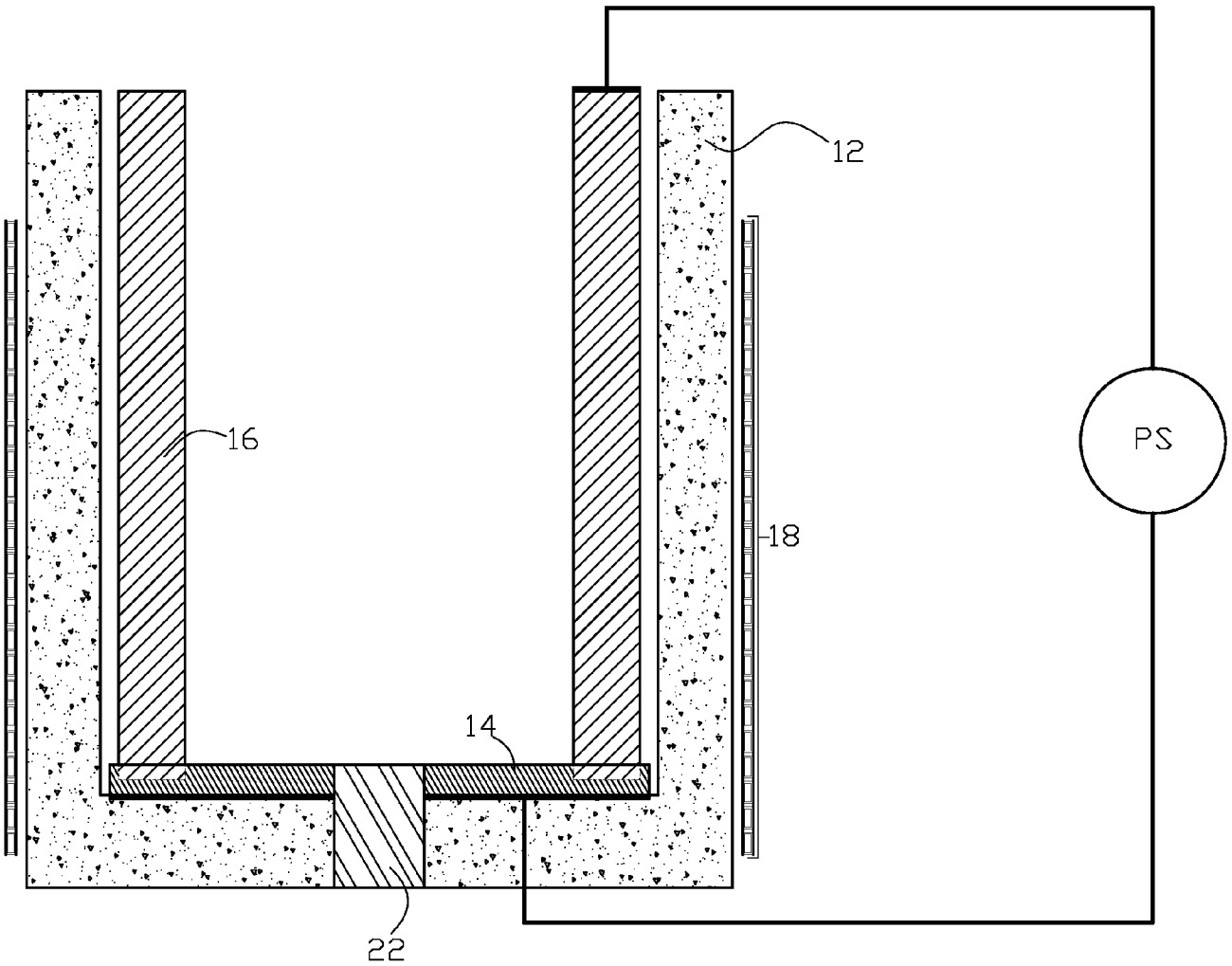

In any example of the invention utilizing a susceptor base and a plurality of susceptor rods, with or without a susceptor tube, wherein electrical continuity is maintained between the connection of a susceptor rod and the susceptor base, either an alternating or direct current source, PS, can be applied between two or more susceptor rods 16, as shown, for example, in FIG. 9(*a*), or between susceptor base 14 and one or more susceptor rods 16 as illustrated in FIG. 9(*b*). If a susceptor tube is used, then it may also be included in the load circuit to the power source. With this arrangement Joule heating of the susceptor material between the connections of the power source can be used to supplement induced heating of the susceptor materials as described above. To enhance Joule heating in the susceptor material, electrical conductors, such as copper conductors, may be embedded in the susceptor material.

Figure 10:
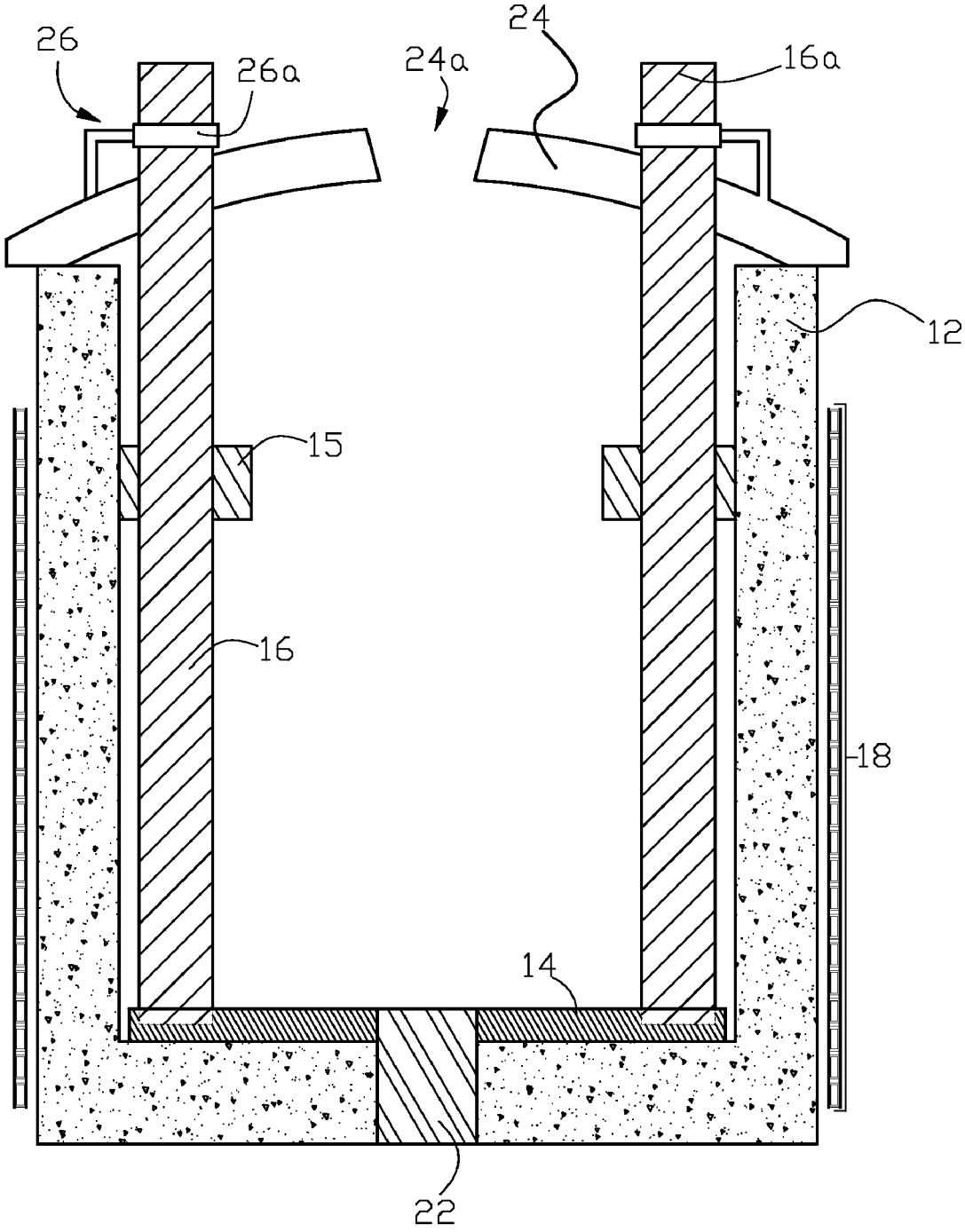
FIG. 10 is a cross sectional elevation view of another example of the electric induction heating and melting apparatus of the present invention.

In all examples of the invention, one or more optional annulus susceptors 15 may be provided along the height of the interior of the furnace to enhance heating in a particular vertical section of the material inside of the crucible as shown in FIG. 10.

Figure 11A:
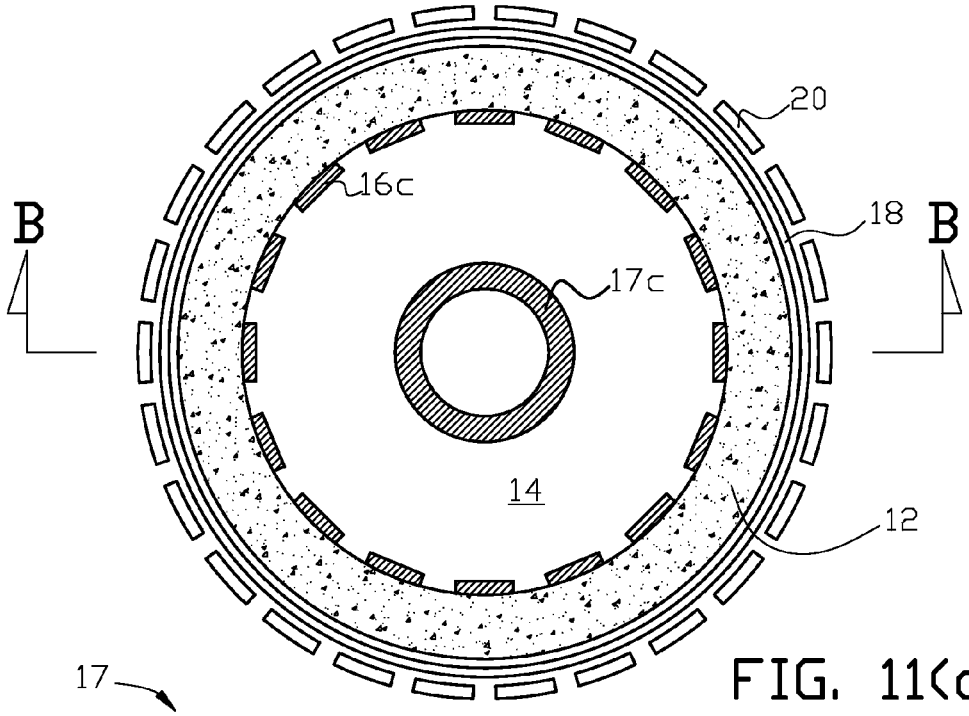
FIG. 11(*a*) is an open top plan view of another example of the electric induction heating and melting apparatus of the present invention.
Figure 11B:
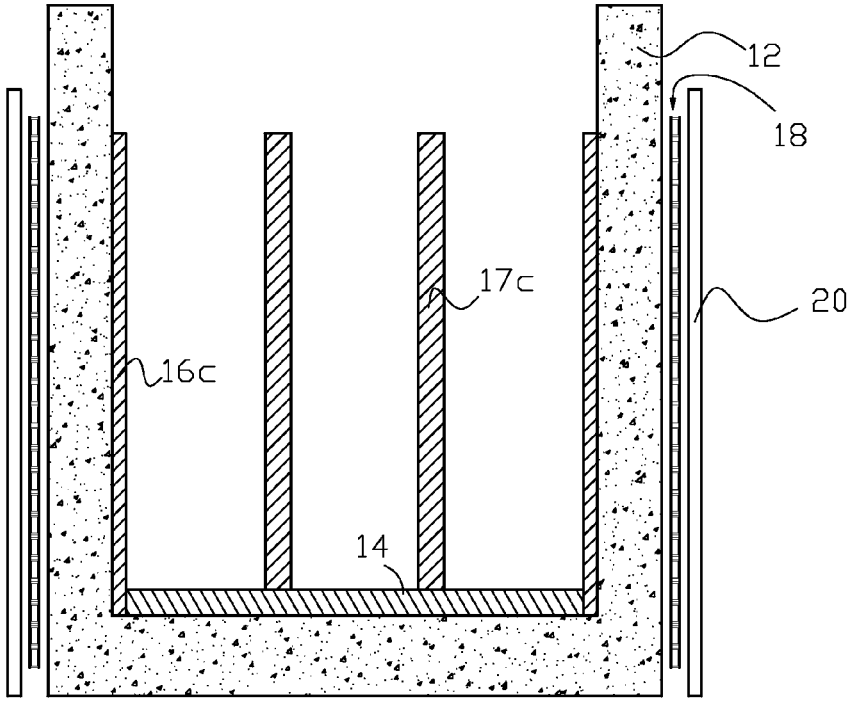

While the perimeter susceptors in the above examples of the invention are configured as cylindrical rods, other shapes may be used as required in a particular application. For example, one acceptable alternative configuration are generally rectangular-shaped perimeter susceptors 16*c*, as shown in FIG. 11(*a*) and FIG. 11(*b*) may be utilized, either with or without a susceptor tube 17*c*, in any of the other examples of this invention.

Figure 12:
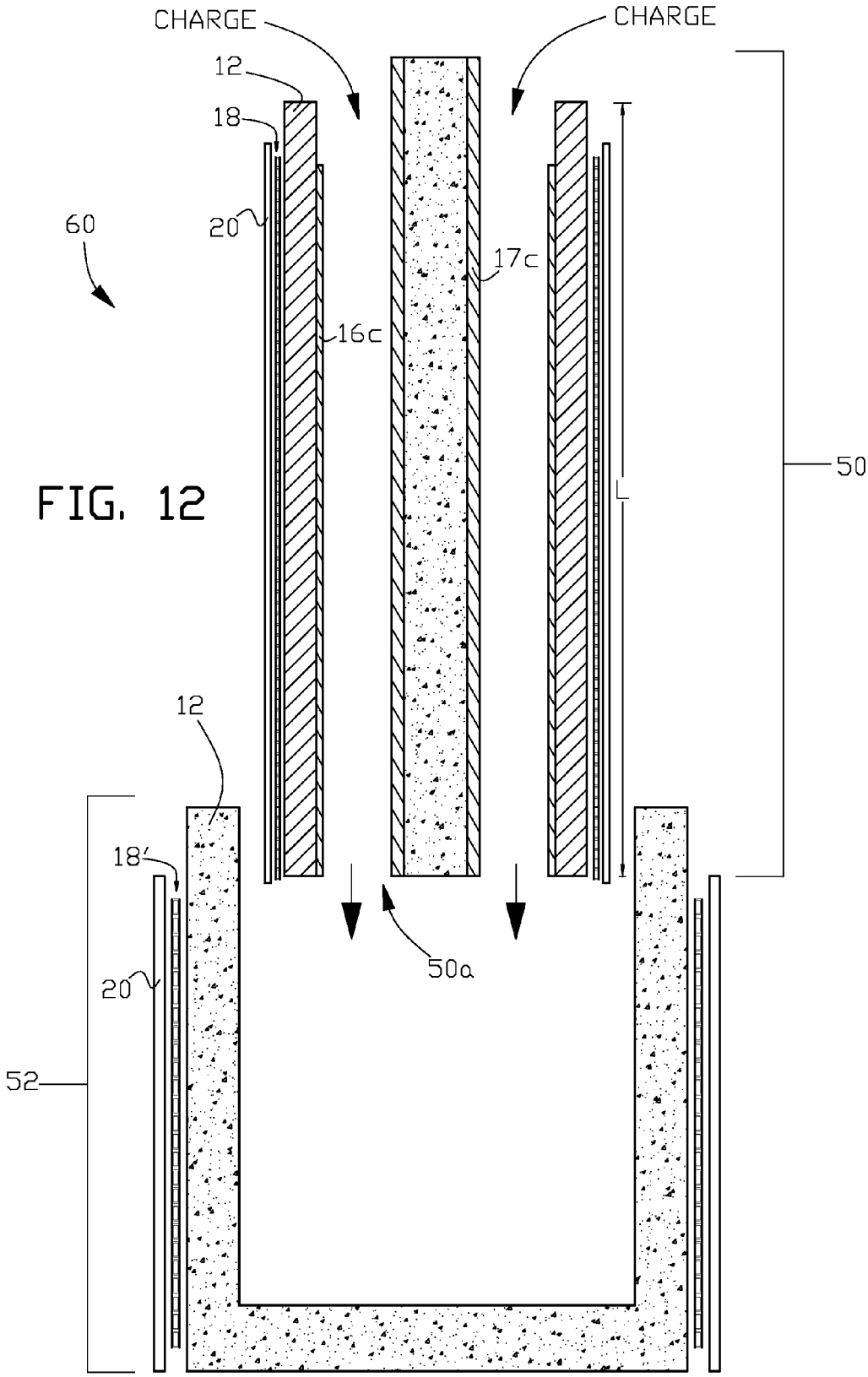
FIG. 12 is a cross sectional elevation view of another example of the electric induction heating and melting apparatus of the present invention.

If the solid charge to molten state process time permits, the electric induction heating and melting furnace of the present invention may be utilized as a continuous molten discharge device 60 as shown in FIG. 12. In this arrangement solid charge feed rate into the top of furnace 50 is coordinated with the melt rate along the length, L, of the furnace so that at open bottom exit 50*a* all solid charge has transitioned to the molten state, and can be gravity, or otherwise fed, into other process equipment, or a holding container, such as a ladle or holding furnace 52 that may be inductively heated, or of other suitable design.

In all examples of the electric induction heating and melting apparatus of the present invention heating and/or melting may be accomplished either at ambient atmosphere or in a controlled environment, such as a vacuum chamber, or under an inert gas atmosphere.

The above examples of the invention have been provided merely for the purpose of explanation and are in no way to be construed as limiting of the present invention. While the invention has been described with reference to various examples or embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses. Those skilled in the art, having the benefit of the teachings of this specification, may effect numerous modifications thereto, and changes may be made without departing from the scope of the invention in its aspects.

The invention claimed is:

1. A method of heating and melting a composition non-electrically conductive in at least a solid state, the method comprising:

placing at least a partially solid charge of a composition in a refractory-formed crucible having an array of discrete susceptor components vertically disposed within an interior volume of the crucible; and adjusting an output frequency of one or more alternating current power sources connected to one or more induction coils surrounding the exterior height of the crucible to selectively control a magnitude of induced heating to the array of discrete susceptor components.

2. The method of claim 1 wherein the array of discrete susceptor components comprises a plurality of susceptor rods vertically arrayed around an interior perimeter of the crucible and a susceptor tube centrally disposed within the interior of the crucible, and adjusting the output frequency of the one or more alternating current power sources further comprises selectively controlling the magnitude of induced heating between the plurality of susceptor rods and the susceptor tube.

3. A method of continuously supplying a molten composition non-electrically conductive in at least a solid state, the method comprising:

supplying at least a partially solid charge of a composition to a top of an open bottom crucible having a plurality of susceptor rods vertically arrayed around an interior perimeter of the open bottom crucible and a susceptor tube centrally disposed within the interior of the crucible; and adjusting the output frequency of one or more alternating current power sources connected to one or more induction coils surrounding the exterior height of the crucible to selectively control a magnitude of induced heating between the plurality of susceptor rods and the susceptor tube to produce the molten composition at the opening at the bottom of the crucible.

4. An electric induction heating and melting apparatus comprising:

a refractory formed crucible;

a susceptor based disposed in a bottom of the crucible;

at least one induction coil at least partially surrounding an exterior height of the crucible;

a plurality of susceptor rods vertically arrayed around an interior perimeter of the crucible, each of the plurality of susceptor rods having a lower end physically and electrically connected to the susceptor base; and a defective susceptor rod sensor device for detecting a damaged susceptor rod.

5. The electric induction heating and melting apparatus of claim 4 further comprising at least one resistive heating power source connected to one or more of the plurality of susceptor rods and the susceptor base.

6. The electric induction heating and melting apparatus of claim 4 further comprising a susceptor rod fastening device for holding at least one of the plurality of susceptor rods vertically in position in the crucible.

7. The electric induction heating and melting apparatus of claim 6 wherein the susceptor rod fastening device further comprises a susceptor rod release and removal mechanism for removal of the at least one of the plurality of susceptor rods while the apparatus is heating or melting a composition placed in the crucible.

8. An electric induction heating and melting apparatus comprising:

a refractory formed crucible;

at least one induction coil at least partially surrounding an exterior height of the crucible;

a plurality of susceptor rods vertically arrayed around an interior perimeter of the crucible, and a bottom tap device for bottom withdrawal of a molten composition from the crucible.

9. An electric induction heating and melting apparatus comprising:

a refractory formed crucible;

at least one induction coil at least partially surrounding an exterior height of the crucible;

a susceptor based disposed in a bottom of the crucible;

a plurality of susceptor rods vertically arrayed around an interior perimeter of the crucible, each of the plurality of susceptor rods having a lower end physically and electrically connected to the susceptor base;

a lid disposed over the top opening of the crucible, the lid forming a sealed environment within the crucible; and a generally vertically oriented outlet tube having a lower end disposed in the crucible and the opposing upper end open to atmosphere, and a supply of a gas for injection of the gas into the sealed environment within the crucible.

10. An electric induction heating and melting apparatus comprising:

a refractory formed crucible;

at least one induction coil at least partially surrounding an exterior height of the crucible;

a susceptor based disposed in a bottom of the crucible;

a plurality of susceptor rods vertically arrayed around an interior perimeter of the crucible, and one or more susceptor tubes vertically disposed in the crucible within an inner perimeter of the plurality of susceptor rods.

11. The electric induction heating and melting apparatus of claim 10 wherein the one or more susceptor tubes comprises a single susceptor tube centrally disposed within the interior of the crucible.

12. The electric induction heating and melting apparatus of claim 11 wherein the single susceptor tube has an annulus-shaped cross section and the interior of the annulus is filled with a refractory.

13. The electric induction heating and melting apparatus of claim 11 wherein the single susceptor tube has an annulus-shaped cross section and the interior of the annulus is an open volume.

* * * * *